United States Patent [19]

Anthony et al.

[11] 4,446,771

[45] May 8, 1984

[54] PROJECTILE FIRING WEAPON WITH WAD DISCHARGE PORT

[76] Inventors: Myron L. Anthony; Shane D. L. Anthony, both of 607 Agana Dr., Grand Junction, Colo. 81501

[21] Appl. No.: 291,021

[22] Filed: Aug. 7, 1981

[51] Int. Cl.[3] ..... F41C 5/06; F42B 13/16

[52] U.S. Cl. ..... 89/14 SB; 102/522

[58] Field of Search ..... 89/14 SB; 102/520–523

[56] References Cited

U.S. PATENT DOCUMENTS 868,938 10/1907 Puff ..... 89/14 SB 3,533,325 10/1970 Barr ..... 89/14 SB

*Primary Examiner*—Donald G. Kelly

*Attorney, Agent, or Firm*—Kinzer, Plyer, Dorn & McEachran

[57] ABSTRACT

A repeating or self-loading firearm has a discharge port between the firing chamber and the breech end of the barrel bore so that a piston inside the cartridge may discharge therethrough upon firing. Rapid, prolonged firing is possible due to a refrigeration principle employed to cool the barrel as an incident to recoil.

7 Claims, 8 Drawing Figures

20
21
22
24
26
27
28
29
30
34
36
38
40
42-1
42-2
44
46
48
50
52
56
60
62
66
68
72
84
84A
84B
86
88
88F
90
92
94
100
102
104
108
110
112
114
116
117
118
122

PROJECTILE FIRING WEAPON WITH WAD DISCHARGE PORT

This invention relates to firearms and in particular one capable of discharging small caliber projectiles at high velocity.

The principles of the present invention were prompted primarily by the thought of a firearm for riot control, discharging a smaller caliber projectile which would not necessarily be lethal in the bone shattering sense or in the sense of causing extensive internal damage due to ricochetting.

One object of the present invention is to achieve this result with a unique (sabot) cartridge, ejecting the sabot (together with any wad) behind the projectile before the latter enters the rifled bore of the barrel.

Another object of the present invention is to enable a high rate of fire to be achieved by a large charge behind a small projectile and a related object of the invention is to cool the barrel in a unique fashion so that a prolonged, high rate of fire may be realized.

IN THE DRAWING

Figures 1, 2, 3:
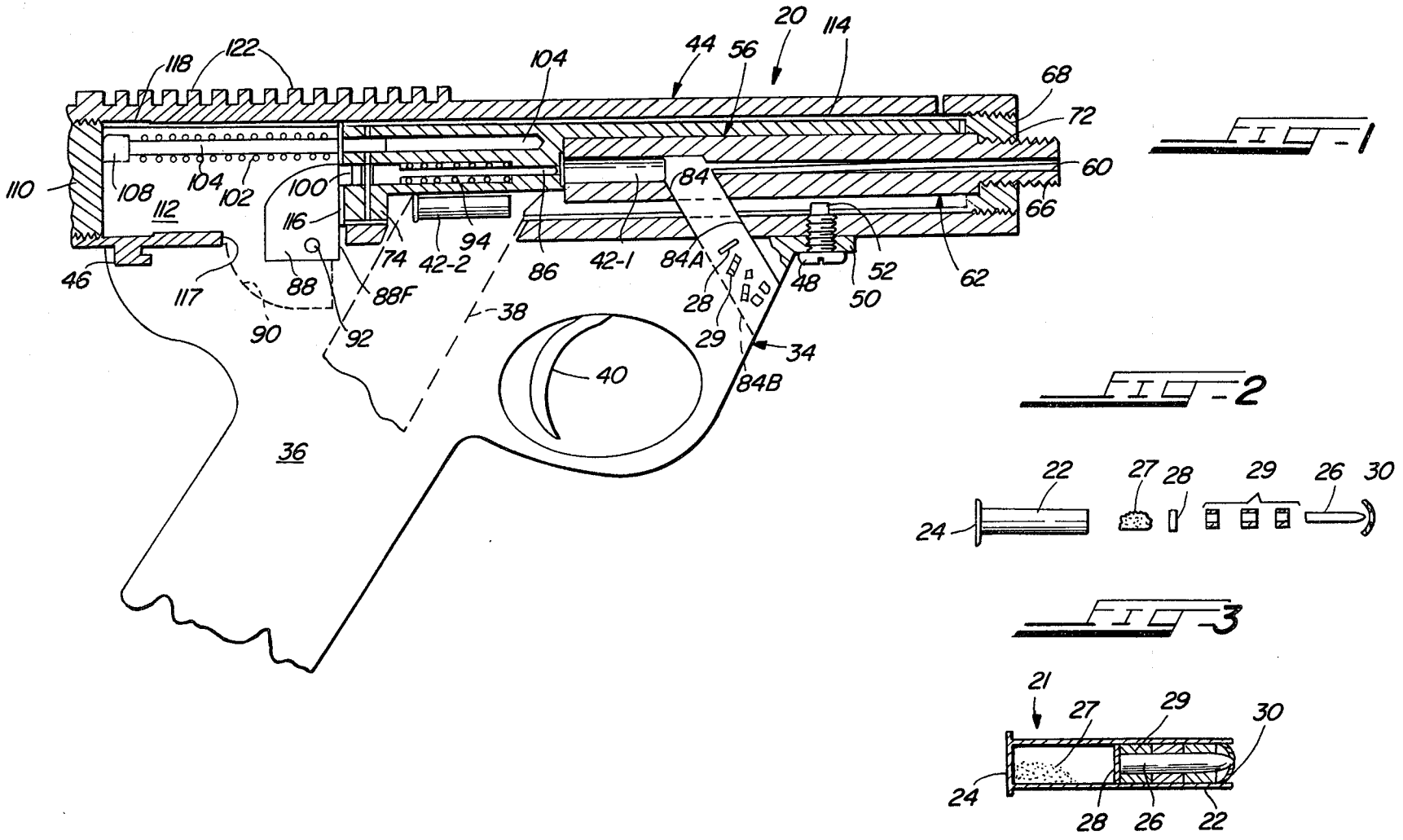
FIG. 1 is a side elevation of a pistol incorporating the principles of the present invention, partly in section.
FIG. 2 is an expanded view of the cartridge.
FIG. 3 is a sectional view of the cartridge.
Figure 6:
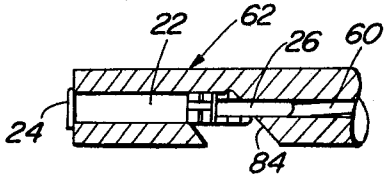
FIG. 6 is a detailed view showing the projectile entering the barrel.

Referring to FIG. 1, the principles of the present invention are shown as embodied in a side arm 20 but could easily be embodied in a shoulder arm, or the side arm shown in FIG. 1 could be equipped with foldable or nestable shoulder stock to convert the side arm to a carbine.

The principles of the present firearm are related to a sabot form of cartridge 21, FIGS. 2 and 3. The cartridge includes the usual brass case 22 which in the present instance may be assumed to be of the caliber .22 size and indeed all parts of the present invention are scaled to a cartridge casing of caliber .22 long rifle size. The casing 22 would, therefore, have a rim 24 adapted to rim fire priming.

The projectile 26, however, is of the so-called BB diameter, that is, caliber .177 preferably of elongated form and weighing about twelve grains.

The charge of powder 27, as usual, is inside the casing, exposed to the effect of the primer. Next a gas-impervious piston 28 (fiber or plastic) is positioned in front of the powder charge and this wafer constitutes a piston effectively sealing the powder charge chamber and also serving, as will be explained, to apply a concentrated driving or impelling force to the rear of the projectile 26. The piston 28 has the same caliber as the internal diameter of the casing 22.

A plurality of centrally drilled wads (felt and/or paper) 29 are assembled concentrically about the elongated projectile 26 with a reasonably tight fit as will be evident in FIG. 3 and finally a nose cap 30, preferably of molded plastic, is positioned on the nose of the projectile serving to center the projectile inside the brass casing 22 and also serving as a seal and a guide for guiding the cartridge into the firing chamber during cartridge feeding. The wads can be of most any cross section: cup-shaped, sleevelike as shown, spool-like and so on.

The sidearm 20 includes a frame 34 affording a pistol-grip 36 in which is housed the assembly for the removable magazine 38 as well as the assembly associated with the trigger 40. The form of the magazine and the mechanics of the trigger assembly constitute no part of the present invention and consequently any preferred arrangement may be employed in this regard including the guide elements (not shown) by which the cartridge 42-2 at the top of the magazine will be fed and guided into the firing chamber following discharge and ejection of cartridge 42-1 which is shown already positioned in the firing chamber of the barrel 62.

A receiver 44 is detachably mounted to the frame, preferably by a lug or guide 46 fitted complementally in a slot at the butt end of the pistol grip 36 and a machine screw 48 at the muzzle end. The machine screw 48 is located in a tang or extension 50 at the forward end of the frame 34, threadedly securing the receiver 44 to the frame 34. The inner end of the screw 48 is machined to provide a guide pin 52 fitting a long slot in the bottom of the bolt 56.

The bolt 56 is slidably fitted and guided on the barrel 62. The receiver 44 has a large bore 58. The rifled bore 60 of the barrel 62 is coaxial with the bore of the receiver 44 so that the receiver, the bolt, and the barrel are all on the same longitudinal axis and accordingly there will be no moments due to eccentricity during operation. The receiver may be die-cast; the bolt and barrel may be made on a lathe or cylindrical grinder.

The barrel is fixed in the receiver by a removable nose or muzzle plug 68 threadedly mounted on the muzzle end 66 of the barrel 62. The plug 68 has a pair of slots (not shown) enabling the plug to be removed by a spanner. The plug 68 has a threaded bore coaxial with the rifled bore of the barrel, and the muzzle end of the barrel is threaded at 72 so the plug 68 may be threaded thereto to fix the barrel to the receiver when the plug 68 is threaded to the receiver.

The barrel is preferably neatly fitted to the bore of the bolt but for reasons to be explained, the O.D. of the bolt clears the I.D. of the receiver by about 1/32" not only for free play of the bolt during recoil and return action, but also for cooling purposes, as will be explained.

Figure 4:
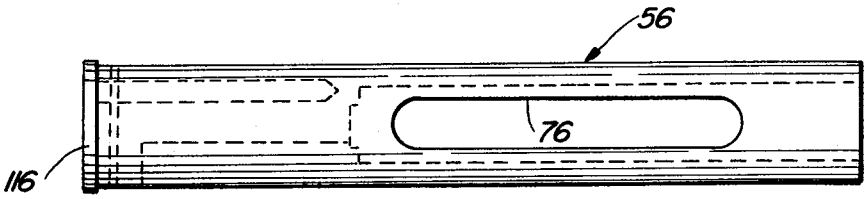
FIG. 4 is an elevation of both.
Figure 5:
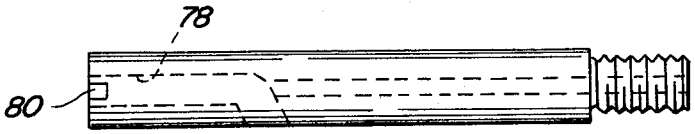
FIG. 5 is an elevation view of the barrel.
Figure 7:
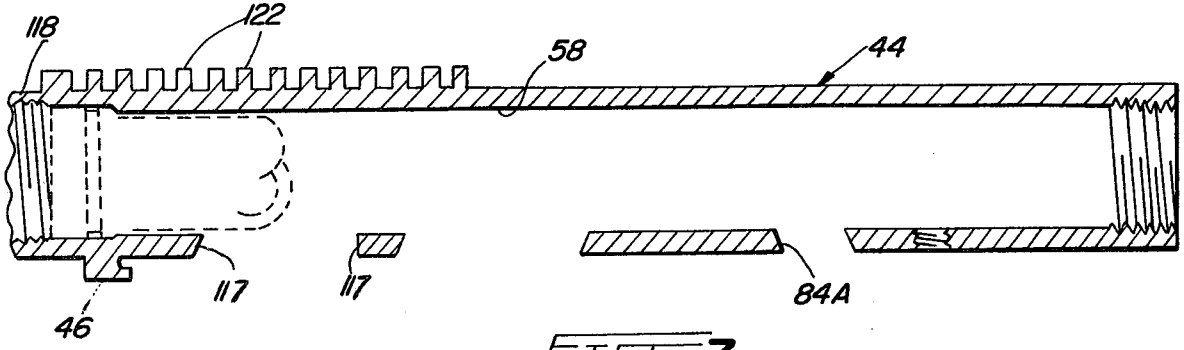
FIG. 7 is a sectional view of the receiver.

The end of the bolt opposite the muzzle end is turned to provide a piston guide 74 having a near piston fit in the bore of the receiver at the butt end of the firearm. As shown in FIG. 4, the bolt has an ejector side slot 76 through which the spent casing will be ejected during recoil. As shown in FIG. 5, the breach end of the barrel at the firing chamber 78 has a milled slot 80 enabling the hook end of a conventional extractor (not shown) on the bolt to be positioned therein to engage the rim of the cartridge, and the inside of the receiver will be provided with the usual ejector pin (not shown) which cooperates with the extractor to "throw" the spent casing out the ejector slot 76 during recoil.

Rapid fire (and indeed automatic fire) can be achieved with this small caliber firearm by virtue of providing a discharge port for the spent sabot piston 28 and wads 29 between the firing chamber and the rifled bore of the barrel. Thus, as shown in FIG. 1, a sabot discharge port 84 is formed in the barrel immediately forward of the firing chamber and this port preferably is inclined downwardly at a forwardly directed angle, communicating with a continuation of the sabot discharge port in the receiver (at 84A) and frame (at 84B)

as shown in FIG. 1. The discharge port 84 has a dimension parallel to the bore less than the length of the projectile but adequate to serve as a funnel for the sabot debris.

The projectile 26 is of a length that when its nose enters the rifled bore on discharge the nose cap begins to become stripped from the projectile while the rear of the projectile continues to be guided by a wad inside the case; this guiding wad and the spent nose cap 26 thus cooperate to center the projectile in the breach end of the rifled bore 60. There is little or no follow-up of expanding gas behind the projectile once it enters the barrel. The powder charge is a heavy one (cal. .22 powder charge for a .11 lead load) and this charge is applied to the sabot (piston) 28 which applies all the force to the projectile which has a much smaller diameter. By the time the projectile is fully into the bore of the barrel it has attained most, if not all, the momentum it will get. In the meantime the spent nose cap, wad and piston will have been separated and the residual back pressure from the initial charge coupled with the recoil of the bolt will expel this stripped material with considerable force through the sabot discharge port. The piston separates first, then the wads, and the last is the nose cap.

The cartridge is fired by a firing pin 86, driven forward to strike the primer cap by a hammer 88 which, when cocked during recoil, is turned 90° to the dashed line position shown in FIG. 1 so that it is located in a complementary shaped slot 90 formed in the frame 34, pivoting on a pin 92.

Figure 8:
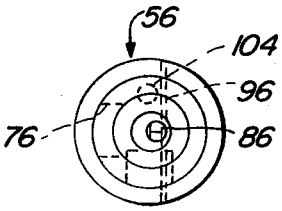
FIG. 8 is a view down the barrel, at the muzzle end.

The firing pin is restored by a coil spring 94, as will be evident in FIG. 1. The firing pin is retained against displacement by a roll pin 96 press-fitted into an opening in the piston head 74 at the end of the bolt. The head 98 of the firing pin is provided with a concavity 100 at one side, wider than the diameter of the roll pin, and the medial portion of the roll pin is disposed therein, permitting limited forward motion of the firing pin when struck by the hammer. In this connection it will be noted from FIG. 8 that the firing pin is off center, typical of the rim fire arrangement.

The bolt, during recoil, compresses a coil spring 102 supported by a guide pin 104 having one end slidably mounted in a recess 106 in the bolt. The coil spring 102, which returns the bolt, normally presses the head 108 of the pin firmly against a butt plug 110 screwed into the left open end of the receiver. When the bolt returns it feeds the next round 42-2 into the firing chamber, as known.

The present firearm is capable of rapid fire over a prolonged period without overheating. This is made possible by cooling the barrel as an incident to recoil. To achieve this, air in the chamber 112 behind the hammer 88 is compressed during recoil, cooled considerably and allowed to expand along the length of the annular space 114 between the bolt and receiver.

To achieve this, the bolt recoiling into chamber 112 is used as a compressor and to this end a gasket or seal 116 of tough material (e.g. Teflon resin) is replaceably secured to the piston head 74 and is of such diameter as to neatly fit the bore of the air chamber 112. Alternatively, a seal ring could be used.

When the hammer 88 is pivoted counterclockwise into cocking position during recoil, its firing pin striking face 88F is neatly presented to the bore of the air chamber 112 in the slot 117 provided therefor in the receiver 44. The air in chamber 112 is compressed more and more as the bolt, serving as a compressor piston moves in the direction of the butt plug 110. Heat, due to compression, is dissipated by radiator fins 122 on the receiver so that isothermal compression is achieved in the compression chamber 112. The compressed air, cooled by radiation, at the same time is compressed more and more into an expansion port in the form of enlarged diameter area 118 (which could just as well be a mere slot) serving as an expansion port. Thus, when the seal 116 passes wholly into the expansion port and slightly beyond, the compression chamber is instantly unsealed, whereupon the compressed air (cooled) instantly expands forwardly down the length of the bolt 56 in the space between the bolt and receiver. The result of expansion is further cooling, and since the bolt is in the recoil position a length of the barrel is exposed to the advancing cold front presented by the expanding body of air. Efficient dissipation of the heat of compression is necessary for isothermal compression and consequently it is preferred that the receiver 44 and especially the fins 122 be of aluminum or aluminum alloy, or other light metal, having a relatively high coefficient of thermal conductivity.

While the weapon shown in FIG. 1 is a side arm, the pistol clearly can be adapted by a stock and hand-held muzzle end strap as in an Ingram sub-machine gun (e.g. see Ingram U.S. Pat. No. 3,651,736) to become a carbine-type shoulder arm, retaining all the other principles of the invention.

While we have shown a hammer 88 (to be released by the trigger of course) to strike the firing pin, the principles of the invention may be employed in a fully automatic weapon in which the firing pin is integral with and fixed to the bolt as in the aforesaid Ingram firearm. However, any preferred system may be used for exploding the cartridge on release of the trigger, whether automatic or semi-automatic. The semi-automatic mode may be that employed in the Colt Woodsman or that employed in High Standard Model GB22; those systems are well known and need not be illustrated or described to those skilled in the art.

The principle of the present invention may be applied to larger calibers and heavier weapons.

We claim:

1. In a magazine-fed firearm having a receiver supported on a frame, a barrel fixed to the receiver and presenting a firing chamber at the breech for receiving a cartridge, and a recoil-operated spring-returned bolt supporting a firing pin, the improvements for firing a cartridge in which a gas-impervious piston is packed between the charge and the projectile, the cartridge casing being of considerably larger caliber than the projectile and the piston having the internal diameter of the casing so as to apply a concentrated driving force to the rear of the projectile upon discharge, which improvements comprise:

a discharge port adjacent the breech of the barrel between the firing chamber and the bore of the barrel and having a long dimension parallel to the bore axis less than the length of the projectile so that on discharge of the cartridge the projectile temporarily spans said port as it attains the barrel bore while being driven by the piston, said port constituting a discharge for the piston.

2. A firearm according to claim 1 further improved in that the bolt is slidably guided by the barrel and the bolt is located in a bore of the receiver which itself is coaxial with the bore of the barrel so that during operation there are no moments due to eccentric bores.

3. A firearm according to claim 2 further improved in that the muzzle of the barrel is threaded to a plug which is threaded in the muzzle end of the receiver.

4. A firearm according to claim 2 or 3 further improved in that the rear end of the receiver is closed by a removable, threadedly mounted butt plug.

5. A firearm according to claim 1 further improved in that the receiver is detachably mounted on a frame which supports the magazine and trigger assemblies, said discharge port extending through the receiver and frame.

6. A firearm according to claim 1 in which the muzzle of the barrel is threaded to a plug in turn threadedly mounted in the muzzle end of the receiver, the receiver being detachably mounted on the firearm, and said discharge port extending through the receiver and frame.

7. In a weapon firing a casing-contained projectile down a barrel bore upon a firing pin striking the casing to explode a charge behind the projectile, and in which the projectile is of considerably less outside diameter than the inside diameter of the casing, with a free piston between the charge and projectile inside the casing: a weapon barrel bore and a firing chamber, a discharge passage between the barrel bore and the firing chamber to allow the piston to drop by gravity, and the length of the passage being less than and spannable by the length of the projectile.

* * * * *